US005517726A

United States Patent [19]

Beier

[11] Patent Number: 5,517,726

[45] Date of Patent: May 21, 1996

[54] HIGH STRENGTH NONWOVEN BATTING

[76] Inventor: Scott B. Beier, 915 N. 20th St., Omaha, Nebr. 68102

[21] Appl. No.: 344,167

[22] Filed: Nov. 23, 1994

Related U.S. Application Data

[63] Continuation-in-part of Ser. No. 931,273, Aug. 17, 1992, abandoned.

[51] Int. Cl.[6] ..... D01G 25/00

[52] U.S. Cl. ..... 19/296; 19/304

[58] Field of Search ..... 19/296, 299, 304, 19/307, 308, 302, 148; 28/103, 105, 107; 428/284

[56] References Cited

U.S. PATENT DOCUMENTS

| | | | |
|---|---|---|---|
| 2,704,734 | 3/1955 | Draper et al. | 154/93 |
| 3,085,309 | 4/1963 | Olson | 28/79 |
| 3,538,564 | 11/1970 | Skoler et al. | 28/72.2 |
| 3,551,265 | 12/1970 | Jackson | 161/57 |
| 4,130,915 | 12/1978 | Gotchel et al. | 19/304 |
| 4,284,680 | 8/1981 | Awano et al. | 428/234 |
| 4,504,538 | 3/1985 | Mussallem, Jr. | 428/167 |
| 4,741,941 | 5/1988 | Englebert et al. | 428/71 |
| 4,888,234 | 12/1989 | Smith et al. | 428/234 |
| 5,007,137 | 4/1991 | Graute | 19/296 |
| 5,093,963 | 3/1992 | Farrington et al. | 19/296 |

FOREIGN PATENT DOCUMENTS 307967 12/1989 European Pat. Off. .

*Primary Examiner*—Michael A. Neas
*Attorney, Agent, or Firm*—Zarley, McKee, Thomte, Voorhees & Sease; Mark D. Frederiksen

[57] ABSTRACT

A high loft high tensile strength fiber batting includes a plurality of highly lofted staple fibers entangled in a high tensile strength netting material to create a high loft batting with high tensile strength. The batting is formed by drawing a sheet of open netting through a stream of airborne fibers at a rate which causes a portion of the fibers to flow completely through the netting to form a lower layer on a suction cylinder below the netting. A portion of the fibers become entangled in the netting with ends depending therefrom to form an intermediate layer. A portion of the fibers become entangled and pile on top of the netting to form an upper layer. The upper and intermediate layers are brought into contact with the lower layer such that the depending ends of the fibers of the intermediate layer become entangled with the fibers of the lower layer to form a batting with a netting locked therein by entanglement of three layers of fibers.

5 Claims, 2 Drawing Sheets

HIGH STRENGTH NONWOVEN BATTING

CROSS-REFERENCE TO RELATED APPLICATION

This is a continuation-in-part application of Ser. No. 07/931,273 filed Aug. 17, 1992, now abandoned.

TECHNICAL FIELD

The present invention relates generally to high loft fiber batting material, and more specifically to an improved high strength nonwoven batting having a netting material incorporated therein.

BACKGROUND OF THE INVENTION

High loft nonwoven batting is a fibrous material which is commonly utilized in such products as filter media, bedspread, comforter, sleeping bag and seat cushion filling, and waterbed wave-dampening baffles. Such batting is conventionally formed from short length fibers (typically one to three inches in length) of either natural or manmade materials. High loft nonwoven batting is used in the above-mentioned applications because of its many unique physical characteristics, including high volume/low weight, softness and resilience, as well as fluid permeability.

Conventionally, such nonwoven batting is formed on specially designed textile machinery, and then stabilized in one of two ways. One method of stabilization is by the application of a binder or glue which fixes fibers in the desired position upon curing of the binder. This type of stabilization is commonly referred to as resin bonding. A second type of stabilization is referred to as thermal bonding, and requires the use of a blend of original fibers with secondary fibers or powders. These secondary fibers or powders will melt when heated and then solidify around the original fiber structure when cooled, so as to lock the fiber structure in position.

Resin bonding and thermal bonding impart a certain degree of tensile strength in the fiber batting which is sufficient to withstand regular handling and minor loads. However, applications of the batting which require higher tensile strengths also require that the conventional batting be reinforced in some fashion. Conventionally, such batting is reinforced with a woven or nonwoven fabric or netting which is attached to a high loft bonded batting.

One method for attaching the high strength fabric to the batting calls for a secondary step wherein the fabric is glued or laminated to the batting in a separate procedure from the batting production process. While the tensile strength of batting with a glued or laminated fabric is increased, this process requires a secondary production process including multiple material handling steps and extra manufacturing machinery and attendant labor, thereby increasing the manufacturing cost of the material. In addition, the fibers of the batting only adhere to the reinforcing fabric at discrete point locations where individual fibers touch the fabric. For this reason, the reinforcing fabric may be separated from the batting relatively easily because of the small attachment area. In order to improve the adhesion of the reinforcing fabric to the batting, one procedure calls for applying pressure to the layered composite during gluing. While this procedure improves adhesion and brings the fabric into contact with fibers deeper within the batting, the desired high loft characteristic is seriously reduced.

A second method for attaching a high strength fabric to a batting is referred to as "needle punching". In the needle punching process, an unbonded batting is laid on top of a high strength fabric. The combination is then punctured by a large number of reciprocating needles having multiple barbs. The needle barbs hook the unbonded fibers and force the fibers through the fabric so as to entangle the unbonded fibers around and through the reinforcing high strength fabric.

The needle punching process suffers several drawbacks. One problem is that the action of large numbers of needles forced through the batting results in a compression of the fibers, thereby increasing the density of the resulting fiber batting. This compression or increased density, is directly opposed to the desired open, high loft characteristics sought in the batting.

Another problem with the needle punching process lies in the fact that the large number of needles being forced through the batting frequently contact threads of the reinforcing fabric, breaking the fabric threads. This in turn reduces the tensile strength sought to be gained by the use of the fabric.

SUMMARY OF THE INVENTION

It is therefore a general object of the present invention to provide an improved high loft high strength fiber batting.

Another object of the present invention is to provide an improved fiber batting which is manufactured without compressing the high loft fibers.

Yet another object is to provide an improved fiber batting which incorporates a high tensile strength reinforcement material without the breakage or tearing of the reinforcement material experienced by virtue of the prior art needle punching process.

Still another object of the present invention is to provide a high loft high tensile strength batting which is manufactured by a process requiring no additional manufacturing steps beyond the process of forming the batting material.

Yet another object is to provide a high loft high tensile strength batting which is economical to manufacture and requires minimal modification of existing equipment.

These and other objects will be apparent to those skilled in the art.

The high loft high tensile strength fiber batting of the present invention includes a plurality of highly lofted staple fibers entangled in and around a high tensile strength netting material to create a high loft batting with high tensile strength. The batting is formed by drawing a sheet of open netting through a stream of airborne fibers at a rate which causes a portion of the fibers to flow completely through the netting to form a lower layer on a suction cylinder below the netting. Said netting to become an integral part of the final product. A portion of the fibers become entangled in the netting with fiber ends depending therefrom to form an intermediate layer. A portion of the fibers become entangled and pile on top of the netting to form an upper layer. The upper and intermediate layers are brought into contact with the lower layer such that the depending ends of the fibers of the intermediate layer become entangled with the fibers of the lower layer to form a batting with a netting locked therein by entanglement of the three layers of fibers.

DESCRIPTION OF THE PREFERRED EMBODIMENT

Figure 1:
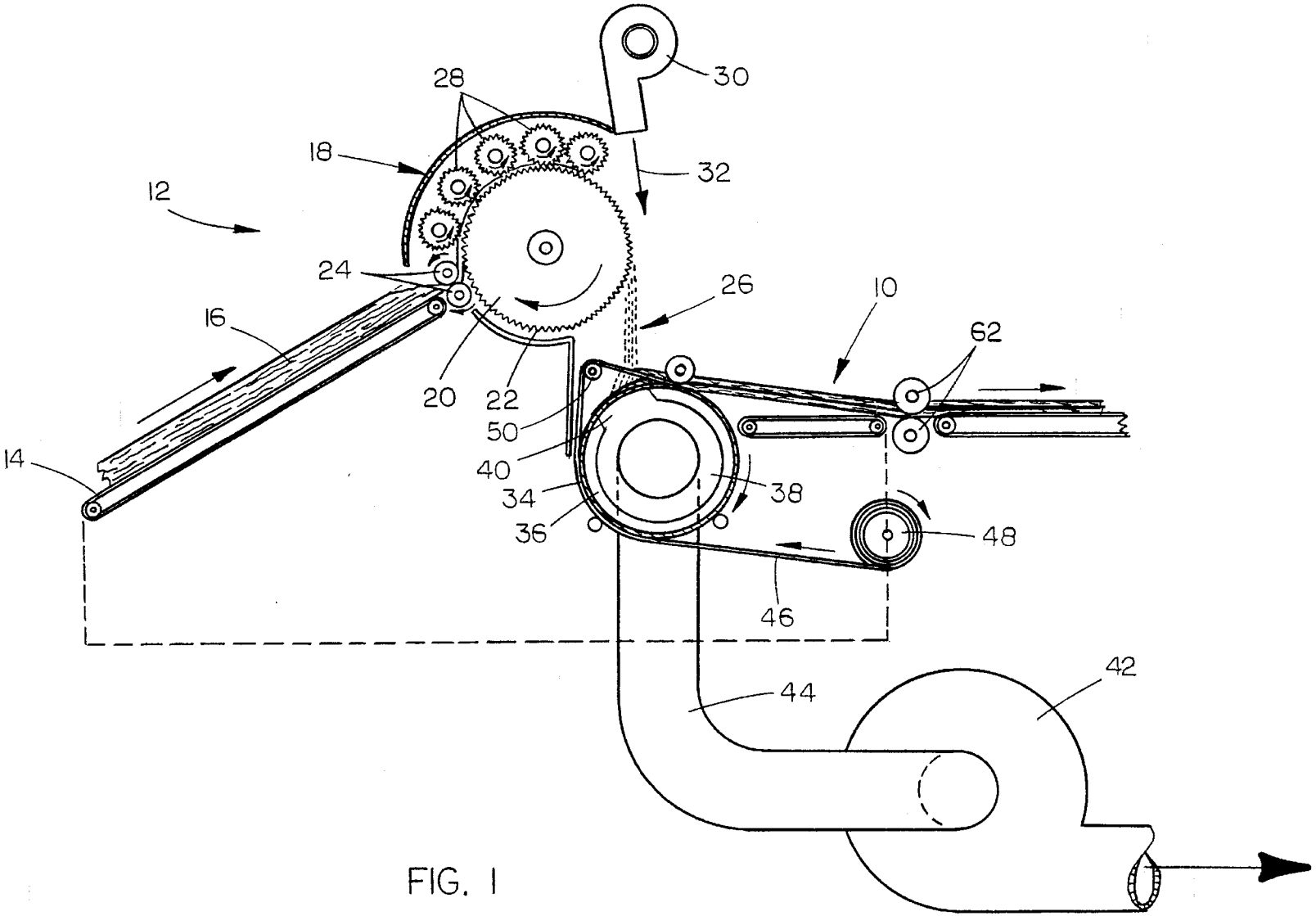
FIG. 1 is a schematic view of an apparatus for forming the batting of the present invention.

Referring now to the drawings in which similar or corresponding parts are identified with the same reference numeral, and more particularly to FIG. 1, the high loft high tensile strength fiber batting of the present invention is designated generally at 10 and is preferably formed on a modified air-lay or aerodynamic carding machine 12.

The conventional air-lay machine includes a feed conveyor 14 which provides a supply of staple fiber material 16 to a fiber separation apparatus designated generally at 18.

The fiber separation apparatus 18 includes a large main cylinder 20 having a large number of sawtooth-shaped teeth 22 arranged on its cylindrical outer surface. Toothed main cylinder 20 rotates in a clockwise direction at a high speed. A pair of feed cylinders 24 feed the staple fibers to the spinning main cylinder where the teeth on the main cylinder hook and pull fibers from the supply. The teeth 22 on main cylinder 20 are of such a size and number that only individual fibers or very small numbers of fibers are pulled by each tooth from the staple fiber supply. The fibers are carried by the main cylinder teeth 22 until the centrifugal forces on the fibers cause the fibers to be thrown outwardly from main cylinder 20. The airborne fibers thrown from the toothed main cylinder 20 are indicated generally at 26.

In order to assist in orienting and separating fibers on the toothed main cylinder, a plurality of toothed stripper cylinders 28 are oriented around a portion of the circumference of the main cylinder. An air supply fan 30 directs an airstream, indicated by arrow 32, onto the toothed surface of main cylinder 20 to assist in the release of fibers from the main cylinder 20, and direct the released fibers generally towards a suction cylinder 34.

Suction cylinder 34 is perforated so as to permit air flow through the surface thereof, and is rotatably mounted on a stationary support cylinder 36. Support cylinder 36 has a hollow interior 38 and a longitudinal slot 40 formed therein to permit the flow of air, indicated generally by arrow 41, through rotating suction cylinder 34 to the interior 38 of cylinder 36 through slot 40. A suction fan 42 is connected to the interior 38 of support cylinder 36 via a duct 44 so as to draw air through perforated suction cylinder 34, and thereby place a suction force on airborne fibers 26, drawing them downwardly towards suction cylinder 34.

In the prior art, the staple fibers thrown from the toothed main cylinder 20 would become entangled with one another as they were drawn onto the rotating suction cylinder 34, forming a high loft batting. The rotation of suction cylinder 34 of a conventional air-lay carding machine would carry the batting past slot 40, releasing the batting from the suction forces, and then forward the batting to a secondary process for installation of the reinforcing fabric.

The inventor herein has modified the conventional air-lay carding machine by interposing a netting material into the stream of airborne fibers 26 between the toothed main cylinder 20 and spaced above suction cylinder 34. A sheet of netting material 46 is dispensed from a supply roll 48 and is directed around a turning bar 50 such that the netting 46 passes through the airborne fibers 26 generally perpendicularly to the stream of airborne fibers 26. The preferred netting material is composed of a mesh of strands 52 of an extruded polypropylene, has a weight of 2.2 lbs. per 1,000 square feet and has an opening size of approximately 0.7 inch by 0.9 inch.

Figures 2, 3:
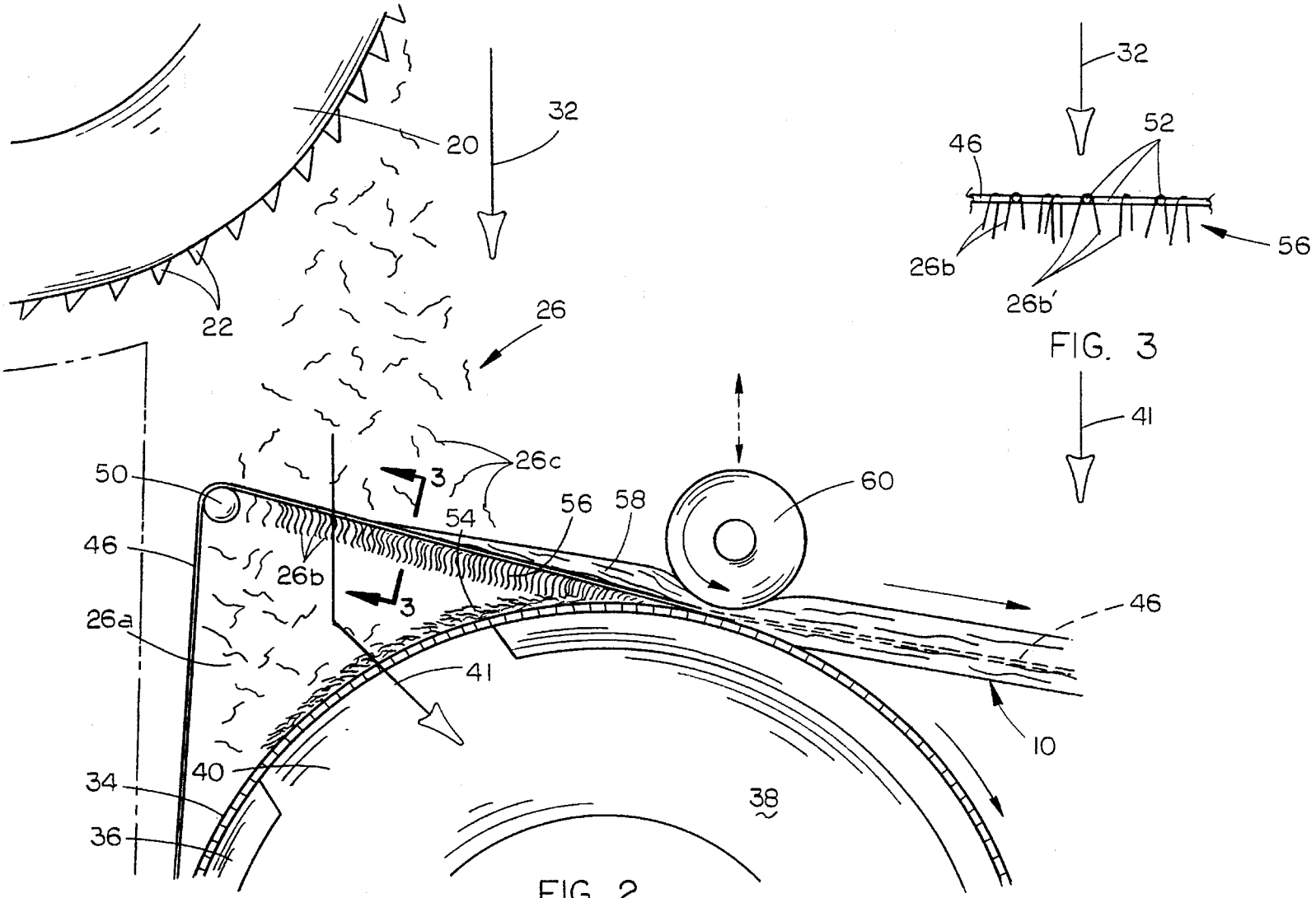
FIG. 2 is an enlarged schematic view similar to FIG. 1, showing the formation of the batting of the present invention.
FIG. 3 is an enlarged sectional view taken at lines 3—3 in FIG. 2.

Referring now to FIG. 2, it can be seen that airborne fibers 26 are drawn downwardly towards netting 46, and that some of the airborne fibers **26*a*, as compelled by air flow 41, will pass completely through the openings in netting 46 and collect on suction drum 34, forming a thin layer 54 thereon. At the same time, other airborne fibers 26*b* will contact strands 52 of netting 46. The continuous air stream 41 blowing through netting 46 towards suction drum 34 causes the ends of fibers 26*b* to be sucked through netting 46 with the ends 26*b*' projecting downwardly towards suction cylinder 34, as shown in FIG. 3. Thus, fibers 26*b* form an intermediate "layer" 56, connected directly to netting 46**.

As fibers **26*b* become entangled with netting 46, the openings in netting 46 will become clogged and closed such that other airborne fibers 26*c* become entangled and build on top of netting 46 to form an upper batting layer 58**.

Referring once again to FIG. 2, the rotation of suction drum 34 will cause lower layer 54 to move beyond slot 40 of support cylinder 36, thereby removing the suction force from lower layer 54, to permit lower layer 54 to be easily pulled away from suction cylinder 34. Simultaneously, the netting 46 (with intermediate layer 56 and upper layer 58) is drawn forwardly by compression roller 60. As the intermediate layer 56 is brought into contact with lower layer 54, the depending fiber ends **26*b*' (shown in FIG. 3) become entangled with the fibers of lower layer 54, thereby capturing netting 46 between lower layer 54 and intermediate layer 56. The pressure applied by compression roller 60 can be increased or decreased as necessary to enhance the entanglement of intermediate layer 56 with lower layer 54. Similarly, upper layer 58 becomes entangled with netting 46 as the upper layer 58 is formed on top of netting 46. It can therefore be seen that netting 46 is locked within the resulting batting 10, being entangled within an upper, intermediate and lower layer of interconnected and entangled fibers 26*c*, 26*b* and 26*a*. A pair of puller rollers 62 (shown in FIG. 1 ) then draw the batting 10 from between suction cylinder 34 and compression roller 60** down the processing line for additional treatment, such as stabilization or the like.

Because the individual airborne fibers are entangled around the netting strands and with each other, the mechanical connection of the fibers to the netting is much stronger than that possible by gluing netting to a batting as described in the prior art. In addition, the batting and fibers are not compressed during a needle punching process, nor does the described process result in breakage of the netting strands which occurs in the needle punching process. In this way, a high loft, open batting is maintained, while incorporating the high tensile strength of the integral reinforcement netting. When utilizing two-inch-long 40 denier polyester staple fibers with the abovedescribed polypropylene netting material, a final batting weight of 1.1 ounce per square foot is achieved while maintaining a line speed of approximately 27 feet per minute. Thus, the modified process does not significantly slow down the formation of the batting material, nor does the netting add appreciable weight to the resulting batting. Yet, high tensile strength is achieved without additional processing steps as required in the prior art.

Whereas the invention has been shown and described in connection with the preferred embodiment thereof, it will be understood that many modifications, substitutions and additions may be made which are within the intended broad scope of the appended claims.

I claim:

1. A method of forming a high loft high tensile strength nonwoven fiber batting, comprising the steps of:

creating a stream of airborne fibers traveling downstream from a fiber source to a fiber collection location, comprising steps of:

(a) providing a toothed main cylinder which rotates to throw fibers from the cylinder teeth;

(b) supplying said toothed cylinder with fiber material from said fiber source;

(c) creating an airstream on said main cylinder directed generally tangential thereto to carry fibers thrown from said cylinder downstream towards said suction cylinder; and (d) providing a suction source at said fiber collection location to direct the stream of airborne fibers towards said netting and towards the suction source;

pulling a netting material formed of a plurality of strands forming a mesh with openings therebetween, through said fiber stream at a location in said fiber stream spaced upstream of the collection location;

pulling said netting material through said fiber stream at a rate which:

(a) causes some fibers to pass completely through said netting material to form a lower layer on said collection location;

(b) causes at least some fibers to become entangled in and around the netting material forming an intermediate layer entangled in and around said netting material with a plurality of fiber end portions projecting downwardly from the intermediate layer through the netting material; and (c) causes at least some fibers to pile on top of the intermediate layer and become entangled therewith to form an upper layer attached to the intermediate layer by said entanglement;

pulling the netting material adjacent said collection location to cause at least some of the fibers of said lower layer to become entangled with at least some of the downwardly projecting end portions of fibers in the intermediate layer to attach the lower layer to the second layer by said entanglement;

said upper, intermediate and lower layers entangled with said netting to form a batting with a netting connected therein by entanglement of fibers in each of said upper, intermediate and lower layers, to form a batting with an integral reinforcing netting.

2. The method of claim 1, wherein the netting material is pulled through the stream of fibers in a direction generally perpendicular to the stream of fibers.

3. The method of claim 1, wherein said fibers are staple fibers.

4. A method of forming a high loft high tensile strength nonwoven fiber batting, comprising the steps of:

creating a stream of airborne fibers traveling downstream from a fiber source to a fiber collection location;

pulling a netting material formed of a plurality of strands forming a mesh with openings therebetween, through said fiber stream at a location in said fiber stream spaced upstream of the collection location;

pulling said netting material through said fiber stream at a rate which:

(a) causes some fibers to pass completely through said netting material to form a lower layer on said collection location;

(b) causes at least some fibers to become entangled in and around the netting material forming an intermediate layer entangled in and around said netting material with a plurality of fiber end portions projecting downwardly from the intermediate layer through the netting material; and (c) causes at least some fibers to pile on top of the intermediate layer and become entangled therewith to form an upper layer attached to the intermediate layer by said entanglement;

pulling the netting material adjacent said collection location to cause at least some of the fibers of said lower layer to become entangled with at least some of the downwardly projecting end portions of fibers in the intermediate layer to attach the lower layer to the second layer by said entanglement;

pulling said netting with the upper and intermediate layers connected thereto between a compression roller and the fiber collection location to cause the intermediate layer to contact the lower layer and to compress the upper, intermediate and lower layers to entangle the layers with each other and with the netting.

said upper, intermediate and lower layers entangled with said netting to form a batting with a netting connected therein by entanglement of fibers in each of said upper, intermediate and lower layers, to form a batting with an integral reinforcing netting.

5. The method of claim 2, further comprising the step of adjusting the compression roller distance from the fiber location to selectively adjust the compression pressure on the layers.

* * * * *